US009298162B2

(12) United States Patent
Mariotto

(10) Patent No.: US 9,298,162 B2
(45) Date of Patent: Mar. 29, 2016

(54) TIMEPIECE BARREL WITH THIN DISKS

(75) Inventor: Elio Mariotto, Solothurn (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 13/234,261

(22) Filed: Sep. 16, 2011

(65) Prior Publication Data

US 2012/0082009 A1 Apr. 5, 2012

(30) Foreign Application Priority Data

Oct. 1, 2010 (EP) ..... 10405181

(51) Int. Cl.
*G04B 1/16* (2006.01)
*G04B 33/06* (2006.01)

(52) U.S. Cl.
CPC . *G04B 1/16* (2013.01); *G04B 33/06* (2013.01)

(58) Field of Classification Search
CPC ..... G04B 1/12; G04B 1/145; G04B 17/066; G04B 33/06; F16F 1/10; G04C 3/008
USPC ..... 368/140, 141, 142
See application file for complete search history.

(56) References Cited

U.S. PATENT DOCUMENTS 716,013 A 12/1902 Erickson
3,922,041 A * 11/1975 Quaile et al. ..... 368/324
5,278,807 A * 1/1994 Mathys ..... 368/140
5,357,489 A * 10/1994 Luthier ..... 368/37
2002/0071348 A1* 6/2002 Rebeaud et al. ..... 368/204
2002/0191493 A1* 12/2002 Hara ..... 368/140
2003/0185105 A1* 10/2003 Scheufele ..... 368/124
2005/0007888 A1* 1/2005 Jolidon ..... 368/110
2009/0116343 A1* 5/2009 Levingston ..... 368/140
2009/0303842 A1* 12/2009 Gritti et al. ..... 368/140
2010/0246339 A1* 9/2010 Mertenat ..... 368/142

FOREIGN PATENT DOCUMENTS

CH 131142 A 1/1929
EP 1 837 717 A1 9/2007
FR 616 436 A 2/1927
FR 1 220 417 A 5/1960

OTHER PUBLICATIONS

European Search Report (ESR) dated Mar. 11, 2011 for EP10405181.

* cited by examiner

*Primary Examiner* — Amy Cohen Johnson
*Assistant Examiner* — Matthew Powell
(74) *Attorney, Agent, or Firm* — Westerman, Hattori, Daniels & Adrian, LLP

(57) ABSTRACT

This timepiece includes a movement with a diameter of less than 40 mm which comprises a barrel (1) for the housing of a mainspring and of which the diameter is less than the radius of said movement. The barrel (1) comprises a cylindrical lateral wall (2), surrounded by a tooth gear (3), of which each edge (21, 21') is closed by a disk (4, 4') traversed axially by an opening (5, 5') for pivoting of a barrel arbor (7). The height of the housing is between 85% and 97% of the total height of the periphery of the barrel (1).

21 Claims, 3 Drawing Sheets

TIMEPIECE BARREL WITH THIN DISKS

Figure 1:
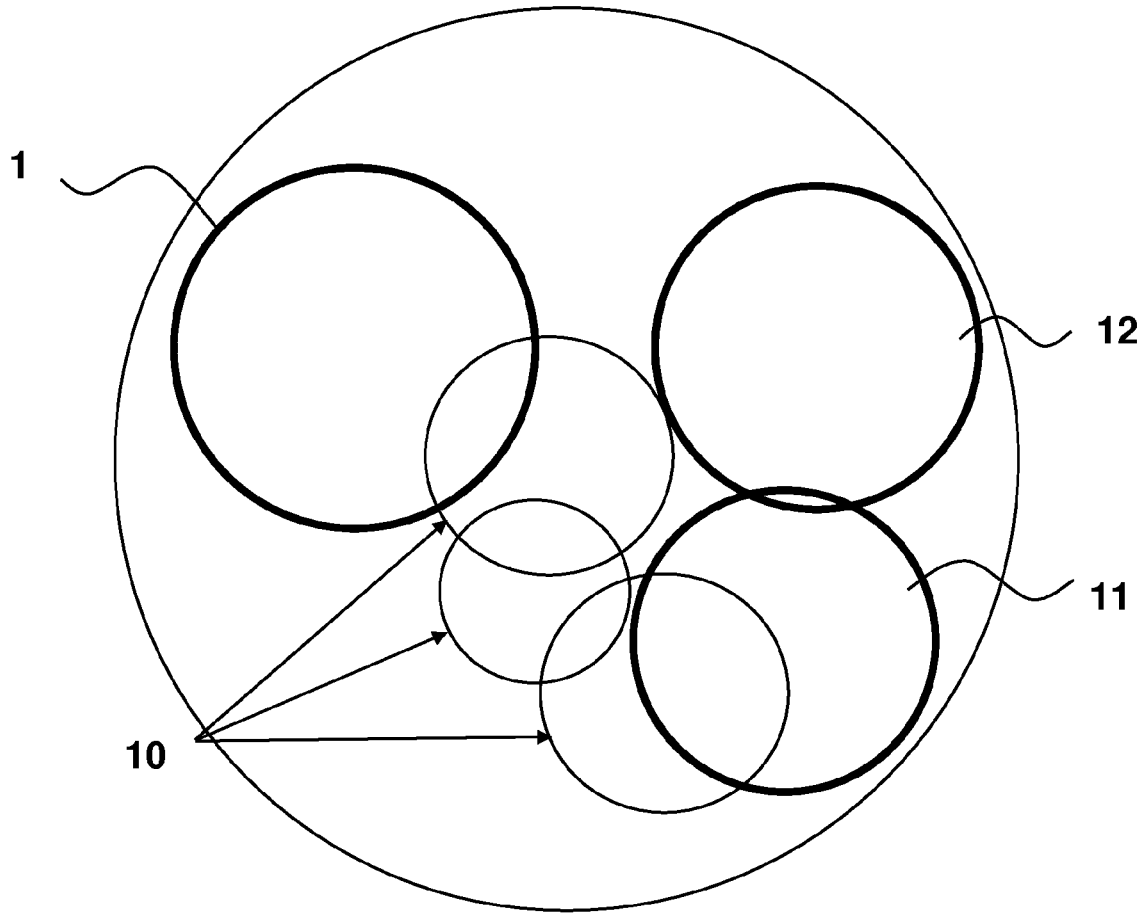

The present invention relates to an horological movement with a diameter of less than 40 mm which comprises a barrel for the housing of a mainspring and of which the diameter is less than the radius of said movement. This barrel comprises a cylindrical lateral wall surrounded by a tooth gear. Each edge of this cylindrical lateral wall is closed by a disk traversed axially by an opening for pivoting of a barrel arbor. The present invention also relates to a timepiece comprising such a movement.

In a mechanical watch, all the energy necessary for the operation of the gear trains of the movement is supplied by the progressive unwinding of the barrel spring. This spring takes the form of a spiral-wound strip. After winding, it is wound between its two ends one of which is held by the lateral wall of the barrel and the other by the barrel arbor. The energy of the spring is transmitted to the going gear train by the tooth gear of the barrel.

Documents FR 1220417 and EP 1837717 describe in detail the construction of barrels for wristwatches. As illustrated in these publications, the barrel drum can be machined in one piece comprising the back and the cylindrical lateral wall. According to the illustrations given in the first document, the walls of the drum and of its cover have totally comparable thicknesses. This arises notably from the fact that the device is designed to combine the drum and its cover so as to obtain a connection that withstands high pressures. The invention described in the second document proposes an attachment of the cover to the drum which modifies neither the external bulk of the barrel nor its internal volume.

To be able to machine properly a barrel drum in a single piece which provides adequate mechanical strength, it is necessary to provide walls with a thickness typically of 0.2 mm.

A major feature of mechanical watches is the power reserve. For a watch the size of a wristwatch, a problem arises from this consisting in storing in the drive member the largest quantity of energy possible in a small volume. Because of their use, such watches naturally have limited dimensions so that it is no longer possible to increase the size of the barrel of which the bulk is defined by the maximum space that can be reserved for it within the movement. For such watches, the diameter of the movement does not usually exceed 40 mm. Since the rotation axis of the hands of the watch is most generally at the center of the movement, the diameter of the barrel is therefore necessarily smaller than the radius of the movement.

The object of the present invention is a barrel which provides a greater power reserve than a conventional barrel of the same bulk or outer dimensions.

Accordingly, the subject of the invention is a movement as claimed in claim 1.

According to the invention, this object is achieved by maximizing the effective height available to the barrel spring for a barrel of given height. The greater the proportion of effective height available to the spring, the greater will be the power reserve of the movement. Specifically, the latter is directly determined, among other things, by the height of the strip forming the spring. According to the present invention, the increase in the height reserved for the spring within the barrel is obtained by reducing the thicknesses of the walls, in particular the thickness of at least one of the two disks forming the back and the cover of the barrel.

One advantage of the invention is that it makes it possible to substantially increase the power reserve without increasing the bulk of the barrel.

Other advantages and specific details will appear in the light of the following detailed description that presents a form of execution and a variant of the invention that are illustrated schematically and as an example by the appended figures in which:

FIG. 1 is a very schematic plan view of a watch movement.

Figure 2A:
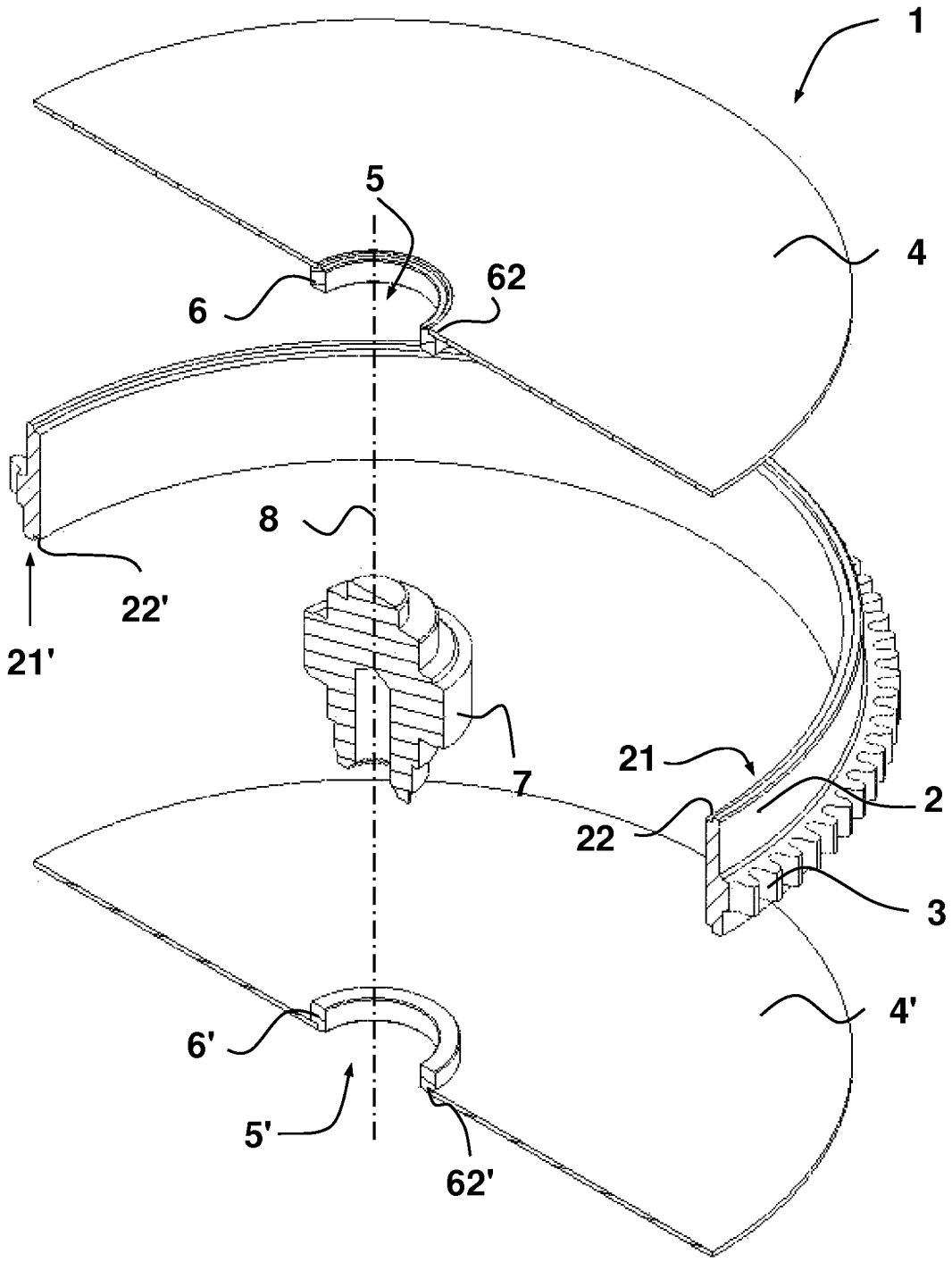

FIG. 2*a* is an exploded view in perspective of the barrel of this movement and of its arbor in axial section.

Figure 2B:
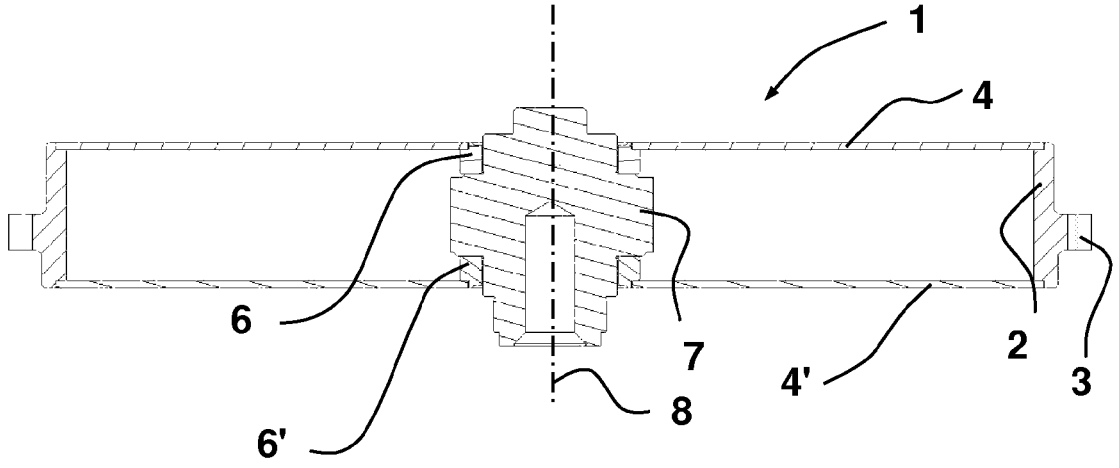

FIG. 2*b* corresponds to an assembled view of the elements illustrated in FIG. 2*a*.

Figure 3:
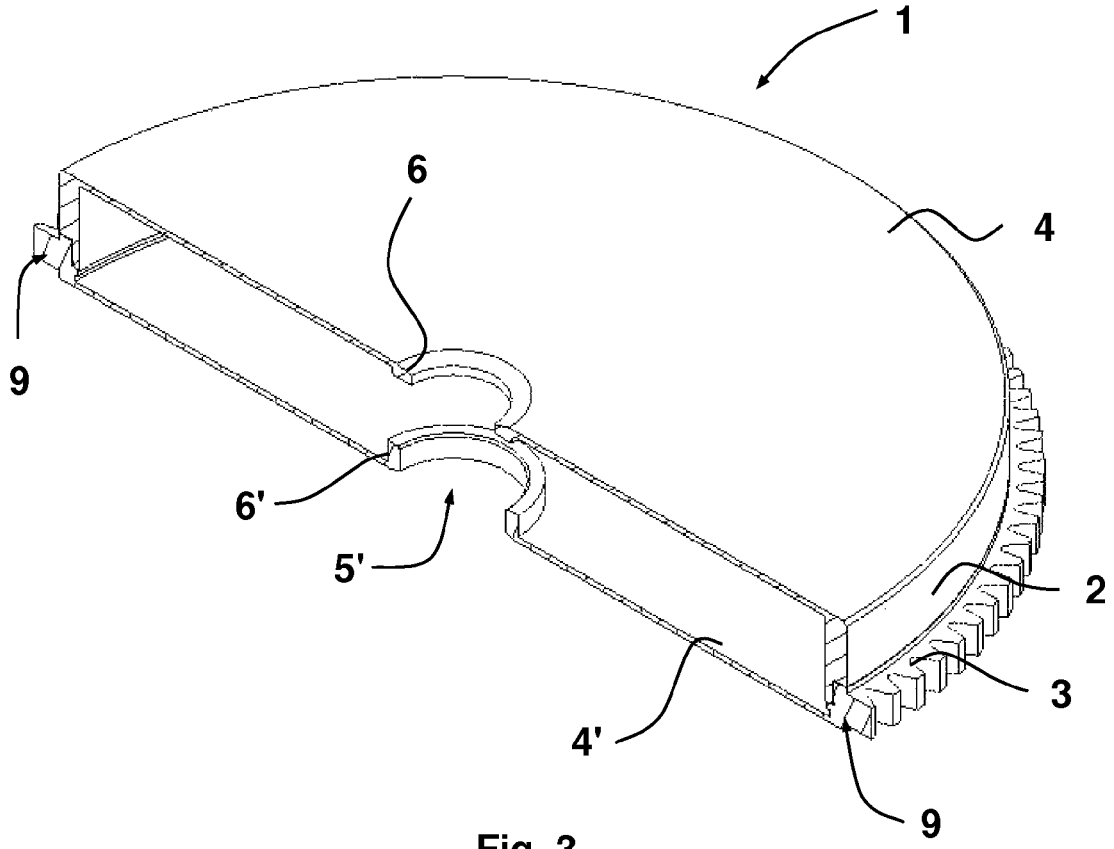

FIG. 3 is a view in perspective and in axial section of a variant of the barrel, the main member of the subject of the invention.

With reference to FIG. 1, it represents a timepiece, in particular its movement. The latter comprises a barrel 1, a going gear train 10, an escapement 11 and a regulator 12.

As shown in FIGS. 2*a* and 2*b*, the barrel 1 consists of a thin cylindrical case of which the internal housing is designed to receive a mainspring (not illustrated). At its periphery, this barrel comprises a tooth gear 3 designed to drive the going gear train 10. The barrel is formed of three distinct parts, namely a cylindrical lateral wall 2 surrounded by the tooth gear 3, and two disks 4, 4', one serving as a cover and the other serving as a back. These two disks are designed to close the space delimited by the cylindrical lateral wall 2, each resting on one of the two edges 21, 21' of this wall. Preferably, the disks rest on a circular shoulder surface 22, 22' formed on the edge of the wall. As a result, and as more clearly illustrated in FIG. 2*b*, the external surface of each disk can advantageously be flush with the edge 21, 21'.

Each disk 4, 4' comprises an axial opening 5, 5' for the passage of a barrel arbor 7 the longitudinal axis 8 of which is perpendicular to the plane of the disks. Each axial opening 5, 5' is edged by an annular protrusion 6, 6' serving as a bearing for the arbor 7.

The height of the housing which this barrel reserves for the mainspring is between 85% and 97% of the total height of the barrel, namely of the distance that separates the external faces of the two disks 4, 4' at the periphery of the barrel, hence without taking account of possible extra thicknesses of the external surfaces of the disks close to the axis. In order to satisfy this feature, at least one of the disks 4, 4' must have a thickness that is substantially less than that which is known in the prior art. According to the prior art, the thickness of the back or of the cover of a barrel drum of comparable size is typically of the order of 0.2 mm.

It has been found that, for a barrel with a diameter of 11.6 mm with a housing height of 73% relative to the total height, designed to be fitted to a wristwatch movement with a diameter of 29 mm, an increase of 0.1 mm in the height of the strip forming the barrel spring resulted in a gain in power reserve of the order of 11%. For a standard watch of which the running time is typically 55 hours, the established gain therefore makes it possible to increase the operating time of the watch by 6 hours. Advantageously, by increasing the height of the spring housing by 0.2 mm by reducing the thickness of each disk of the barrel by 0.1 mm, the gain in power reserve of the watch can be increased to 22% (housing height of 86%). Such a value makes it possible to obtain a comfortable running time of 67 hours, compared with the 55 hours that the same watch fitted with a standard barrel of the same bulk provided hitherto. By using a disk 4' with a thickness of 0.1 mm and a disk 4 with a thickness of 0.05 mm (housing height of 90%), the gain in power reserve is 27% which corresponds to a running time of 70 hours. If the two disks 4, 4' have a thickness of 0.05 mm (housing height of 93%), this gain is taken to 31% and the running time to 72 hours.

According to the invention, at least one of the disks 4, 4' is a disk of reduced thickness which has a thickness of less than 0.2 mm, preferably a thickness of between 0.04 mm and 0.12 mm. Advantageously, this thickness of at least one of the disks 4, 4' is therefore less than or equal to 0.12 mm, or even less than or equal to 0.10 mm, or even less than or equal to 0.09 mm, or even less than or equal to 0.08 mm.

Although the gain and the value that arise from said finding are abundantly clear, reducing the thickness of the circular walls of the barrel however causes several difficulties from the point of view of the production and the mechanical strength of the barrel.

The first difficulty resides in obtaining disks greatly reduced in thickness which thereby are extremely thin, typically less than 0.08 mm, for example of the order of 0.04 mm only. Below this first value, it becomes virtually impossible to obtain a quality part from a mechanical machining.

In order to obtain extremely thin disks, it is advantageously possible to use materials such as ceramic, obtained by sintering, ruby, or Phynox®, a high-performance cobalt-based metal alloy which is stainless, has a great mechanical strength and makes it possible to obtain the abovementioned disks by stamping, or else Toughmet® or Pfinodal®, which are copper-based spinodal alloys with added nickel and tin. It is also possible to use materials capable of being formed by microfabrication processes such as electro-forming (for example, Ni, NiP, NiCo alloys obtained by a method of the LIGA type which is an abbreviation for "Lithographie, Galvanoformung, Abformung" (lithography, electroplating and molding)) or deep etching (for example, silicon, quartz or diamond by a process of the DRIE type, an abbreviation for "Deep Reactive Ion Etching").

The second difficulty, which stems from the first, lies in the machining of the annular protrusion 6, 6' which, in order to provide an adequate pivoting of the barrel 1 relative to the arbor 7, becomes increasingly necessary the thinner the disk with which it is associated. For this reason, the annular protrusion 6, 6' can be fitted to the surface of the disk 4, 4' after it has been machined separately. Because of this, this annular protrusion may advantageously be made of a material different from that of the disk. This makes it possible to choose a material for the protrusion that provides good tribological characteristics in order to optimize the pivoting, but which is not necessarily suitable for producing the disk. Typically, to produce this protrusion, it would be preferable to use conventional alloys such as CuBe or brass, or a metal such as nickel which prevents any seizing while having excellent wear resistance. The annular protrusion can be joined to the disk by welding, by riveting, by brazing or by bonding. Preferably, the bearing of the disk 4, 4' on the annular protrusion is achieved by means of a circular bearing surface 62, 62' which notably makes it possible to protect the edge of the axial opening 5 situated immediately next to the barrel arbor.

FIG. 3 illustrates a variant of the barrel according to the invention. On the one hand note that the annular protrusion 6, 6' is not necessarily fitted to the disk 4, 4' but can be formed in a single piece with the disk with which it is associated. On the other hand, note that the same may apply for the tooth gear 3 which constitutes or is arranged in an extra thickness of the periphery of the disk. It is also possible to note that one of the disks 4, 4', in this instance the disk 4, can be formed in a single piece with the cylindrical lateral wall 2. In this case, the fitting of the two portions thus formed of the barrel can for example consist of the internal face of a shoulder 9 in which the tooth gear 3 is arranged and of a bearing surface arranged in the edge of the circular lateral wall 2, as illustrated in FIG. 3. The two portions can be connected together by bonding or by welding during the assembly and the closure of the barrel, as is also possible for the disks 4, 4' of FIG. 2. It is also possible to produce such an assembly by chasing, riveting or clipping.

Such an attachment method, which attaches at least one of the disks to the cylindrical wall, makes it possible to improve the rigidity of the barrel.

It is also possible to reduce the thickness of only one of the two disks or else to create a barrel from two half-drums, formed for example, for one of them, of a disk and a first top half of cylindrical lateral wall and, for the other, of the other disk and a second bottom half of cylindrical lateral wall surrounded by its tooth gear. The aforementioned two halves can be assembled by using a means that is identical or comparable to that of FIG. 3 and can be connected together by bonding or by welding. It is also possible to achieve such an assembly by chasing or clipping.

The form of execution and the variants described above can be taken, either in their totality, or in part or separately in the production of the barrel 1.

According to the invention, it will be noted that the circular wall 2, serving notably as an anchor point for the external end of the mainspring and as a sliding surface in the case of a spring with slipping spring, retains its normal thickness which gives it the rigidity necessary for the strength of the whole barrel.

The invention claimed is:

1. A movement with a diameter of less than 40 mm which comprises:

a housing for a mainspring, said housing having a diameter of less than a radius of said movement, and a barrel for the housing, said barrel comprising (i) a cylindrical lateral wall surrounded by a tooth gear and (ii) rigid disks respectively closing each of respective peripheral ends of the cylindrical lateral wall, said disks being traversed axially by respective openings for pivoting of a barrel arbor, wherein a periphery of the opening of at least one of the disks is edged by an annular protruding part, wherein the at least one of the disks (i) is flat in all directions extending radially from an external edge of the annular protruding part to an external edge of the disk, and (ii) has a constant thickness in all directions extending radially from the external edge of the annular protruding part to the external edge of the disk, and a peripheral edge of the at least one disk is joined to the respective peripheral end of the cylindrical lateral wall by resting on a shoulder of the respective peripheral end of the cylindrical lateral wall between the internal edge and an external edge of the cylindrical lateral wall, wherein a height of said housing is in a range of from 85% to 97% of a total height of a periphery of the barrel, and wherein at least one of said disks has a thickness in a range of from 0.04 to 0.12 mm.

2. The movement as claimed in claim 1, wherein each of the disks has a thickness in a range of from 0.04 to 0.12 mm.

3. The movement as claimed in claim 1, wherein the at least one of said disks has a thickness of less than 0.10 mm.

4. The movement as claimed in claim 1, wherein the annular protrusion is assembled by fitting to a peripheral edge of the opening of the at least one disk.

5. The movement as claimed in claim 4, wherein said annular protrusion is made of a material different from that of the disk.

6. The movement as claimed in claim 5, wherein said annular protrusion is fitted to the surface of the disk by at least one of bonding, welding and riveting.

7. The movement as claimed in claim 4, wherein said annular protrusion is fitted to the surface of the disk by at least one of bonding, welding, brazing, and riveting.

8. The movement as claimed in claim 1, wherein at least one of the disks is joined to said cylindrical lateral wall by at least one of welding and bonding.

9. The movement as claimed in claim 1, wherein said tooth gear is arranged in an extra thickness secured to one of the disks.

10. The movement as claimed in claim 1, wherein the at least one of said disks is made of at least one of ceramic, high-performance cobalt-based stainless alloy, and copper-based spinodal alloys with added nickel and tin.

11. The movement as claimed in claim 1, wherein the at least one of said disks is made of at least one of silicon, quartz and diamond.

12. A timepiece comprising a movement as claimed in claim 1.

13. The movement as claimed in claim 1, wherein the at least one of said disks has a thickness of less than 0.09 mm.

14. The movement as claimed in claim 1, wherein the at least one of said disks has a thickness of less than 0.08 mm.

15. The movement as claimed in claim 1, wherein each of the disks has a thickness of less than 0.10 mm.

16. The movement as claimed in claim 1, wherein each of the disks has a thickness of less than 0.09 mm.

17. The movement as claimed in claim 1, wherein each of the disks has a thickness of less than 0.08 mm.

18. The movement as claimed in claim 1, wherein the at least one of the disks is assembled to the cylindrical lateral wall by fitting.

19. The movement as claimed in claim 18, wherein the at least one of the disks is fitted to the cylindrical lateral wall by at least one of bonding, welding, chasing, riveting, or clipping.

20. The movement as claimed in claim 1, wherein an external surface of the at least one disk is flush with the respective peripheral end of the cylindrical lateral wall, wherein the external surface of the at least one disk and the respective peripheral end of the cylindrical lateral wall are within a same plane.

21. A movement with a diameter of less than 40 mm which comprises:

a housing for a mainspring, said housing having a diameter of less than a radius of said movement, and a barrel for the housing, said barrel comprising (i) a cylindrical lateral wall surrounded by a tooth gear and (ii) rigid disks respectively closing each of respective peripheral ends of the cylindrical lateral wall, said disks being traversed axially by respective openings for pivoting of a barrel arbor, wherein a periphery of the opening of at least one of the disks is edged by an annular protruding part, wherein the at least one of the disks (i) is flat in all directions extending radially from an external edge of the annular protruding part to an internal edge of the cylindrical lateral wall, and (ii) has a constant thickness in all directions extending radially from the external edge of the annular protruding part to the internal edge of the cylindrical lateral wall, and a peripheral edge of the at least one disk is joined to the respective peripheral end of the cylindrical lateral wall by resting on a shoulder of the respective peripheral end of the cylindrical lateral wall between the internal edge and an external edge of the cylindrical lateral wall, wherein a height of said housing is in a range of from 85% to 97% of a total height of a periphery of the barrel, and wherein at least one of said disks has a thickness in a range of from 0.04 to 0.12 mm, wherein an external surface of the at least one disk is flush with the respective peripheral end of the cylindrical lateral wall, wherein the external surface of the at least one disk and the respective peripheral end of the cylindrical lateral wall are within a same plane.

* * * * *